US005552767A

United States Patent [19]

Toman

[11] Patent Number: 5,552,767

[45] Date of Patent: Sep. 3, 1996

[54] ASSEMBLY FOR, AND METHOD OF, DETECTING AND SIGNALLING WHEN AN OBJECT ENTERS A WORK ZONE

[76] Inventor: John R. Toman, 1202 Orchard Village La., Manchester, Mo. 63021

[21] Appl. No.: 194,931

[22] Filed: Feb. 14, 1994

[51] Int. Cl.[6] ..... G08B 21/00

[52] U.S. Cl. ..... 340/540; 340/552; 340/556; 340/555; 340/908.1; 340/331

[58] Field of Search ..... 340/540, 552, 340/553, 554, 555, 557, 556, 331, 908.1, 691, 529

[56] References Cited

U.S. PATENT DOCUMENTS

| | | | |
|---|---|---|---|
| 3,711,846 | 1/1973 | Schlisser et al. | 340/557 |
| 3,733,602 | 5/1973 | Cuckler et al. | 340/552 |
| 3,877,002 | 4/1975 | Cheal et al. | 340/552 |
| 3,938,080 | 2/1976 | Hulme | 340/908.1 |
| 4,297,684 | 10/1981 | Butter | 340/566 |
| 4,408,195 | 10/1983 | Tullis et al. | 340/557 |
| 4,417,235 | 11/1983 | Del Grande | 340/522 |
| 4,665,379 | 5/1987 | Howell et al. | 340/426 |
| 4,827,245 | 5/1989 | Lipman | 340/473 |
| 4,841,278 | 6/1989 | Tezuka et al. | 340/331 |
| 5,049,858 | 9/1991 | Price | 340/552 |
| 5,198,799 | 3/1993 | Pascale | 340/552 |

OTHER PUBLICATIONS

"Warning Signal For Highway Workers", SHRP Product Catalog, National Research Council, 1992, p. 7.

*Primary Examiner*—Brent A. Swarthout
*Assistant Examiner*—Benjamin C. Lee
*Attorney, Agent, or Firm*—Howell & Haferkamp, L.C.

[57] ABSTRACT

An assembly for detecting and signalling when an object enters a work zone including a plurality of transmitter-sensor pairs serially connected along a section of the work zone perimeter for detecting when an object passes therethrough. Once an object is detected, an optical warning signal is activated. The optical warning signal includes a primary strobe and a plurality of relay strobes positioned throughout the work zone. The primary strobe flashes at a predetermined flash rate which is detected by a photoelectric sensor in a nearby relay strobe. The nearby relay strobe begins flashing at the predetermined flash rate thereby activating another relay strobe in close proximity. This cascading strobe effect saturates the work zone.

10 Claims, 2 Drawing Sheets

ASSEMBLY FOR, AND METHOD OF, DETECTING AND SIGNALLING WHEN AN OBJECT ENTERS A WORK ZONE

FIELD OF THE INVENTION

This invention relates generally to an assembly for, and method of, detecting and signalling when an object enters a work zone and more particularly to providing an optical warning signal when an object enters a roadway work zone.

BACKGROUND AND SUMMARY OF THE INVENTION

Traffic accidents on a given section of roadway greatly increase while road work is performed in or near the roadway section. Lane restrictions, traffic speed fluctuations, bi-directional traffic flow, vehicles entering and exiting the roadway, and the general distracting surroundings of a work zone contribute to the propensity of accidents in and around roadway work zones. This propensity for accidents poses a very real risk to road construction crews, utility crews, maintenance workers, and other personnel in the vicinity of a work zone. It is not uncommon for accident rates to increase 50% or more during times of construction, and these accidents are increasingly causing injury and death to work zone personnel. Along with the human tragedy of the increased work zone related injuries and deaths, contractors suffer economically as well from worker's compensation rate increases, increased tort liability, and decreases in worker productivity and morale as work zone personnel pay greater attention to oncoming traffic and less attention to their work assignments.

Various devices and techniques are known which attempt to alert drivers to approaching roadway hazards. These devices were designed to make drivers more aware of their surroundings and/or to reduce the speed of vehicles approaching roadway hazards. These prior art techniques include: regulatory and advisory signage, dynamic speed limit signage, mock-up police cars, high visibility clothing, and traffic flow diversion devices, to name but a few. While these prior art devices and techniques undoubtedly deterred countless additional work zone related accidents, those devices are directed solely at alerting drivers of an approaching hazard. Those devices had no way to warn work zone personnel if or when a vehicle strayed from a designated traffic lane and breached the work zone perimeter.

A device is known which attempts to signal highway workers when an errant vehicle entered the work zone. However, the harsh environment of the roadway work zone proved too large an obstacle for this device to efficiently warn workers. The device comprises an infrared signal with a reflective cone, or an ultrasonic beam, to detect a vehicle passing thereby. The infrared signal or ultrasonic beam is positioned "upstream" from the work zone and is placed at 90° to the oncoming traffic. This detector is in communication via a wireless data link to a 120 decibel siren positioned within the work zone. When a vehicle is detected upstream, a signal is transmitted to the siren and the siren sounds an audible warning. Another embodiment of this device uses a pneumatic tube laid across the roadway in place of the infrared or ultrasonic beam.

The problems with this warning device are numerous. First, most work zones are very noisy. In addition to the traffic noise and wind along any stretch of roadway, many work zones use heavy construction machinery, and jackhammers, shot blasters, and concrete cutters which create a tremendous amount of noise. Because Occupational Safety and Health Administration ("OSHA") standards required operators of this machinery to wear hearing protection, the operators were unable to hear the audible warning over the noise of the equipment they were operating and through their hearing protection. Further, even without hearing protection, personnel in the vicinity of this machinery and equipment often did not hear the audible warning.

Second, this warning device suffers several integrity problems. Because the device uses a single detector positioned "upstream" from the work zone and at 90° to approaching traffic, it is possible for vehicles to enter the work zone without tripping the detector. Moreover, the heat and audible noise produced by work zone equipment and passing traffic would interfere with the prior art infrared and ultrasonic detectors causing false detections. Further, the distance between the detector and the siren necessitated a wireless data link therebetween. Modern work zones are flooded with electromagnetic noise within the popular communication frequencies. The frequent use of walkie-talkies by work zone personnel, portable and cellular telephones by work zone personnel and passing traffic, and CB and short wave radio by passing vehicular and air traffic would trigger the siren causing a significant problem with false alarms. Furthermore, this transmission required FCC compliance as well.

The present invention overcomes the foregoing problems by providing an intrusion alarm including a detector and a device for producing an optical warning signal to provide a visual warning when vehicles enter the work zone. The detector comprises a plurality of transmitter-sensor pairs connected in series along the work zone perimeter adjacent to active traffic. This serial connection detects vehicles breaching the work zone perimeter regardless which transmitter-sensor pair the vehicle passes between, thereby eliminating the risk of an errant vehicle from the active lane entering the work zone undetected.

The optical warning signal includes a primary strobe and a plurality of relay strobes arranged throughout the work zone. The primary strobe and relay strobes each include an illuminator capable of generating light flashes at a predetermined flash rate. The relay strobes also include a photoelectric sensor which detects light flashes at the predetermined flash rate. The primary strobe is electrically connected to the sensor of the transmitter-sensor pair farthest downstream. The primary strobe is activated upon a vehicle passing between any of the serially connected transmitter-sensor pairs. When activated, the primary strobe illuminator begins flashing at the predetermined flash rate. The photoelectric sensor of at least one relay strobe detects the predetermined flash frequency and activates its relay illuminator which flashes light at the predetermined flash rate thereby activating at least one other relay strobe. This cascading effect continues until the entire work zone is saturated with flashing light. The relay strobe can be portable so that work zone personnel positioned behind a barrier or operators required to look downward a high percentage of the time can place the strobe in their close proximity.

Generally, the method of this invention comprises serially connecting the plurality of transmitter-sensor pairs along a section of the work zone perimeter, energizing the primary strobe illuminator upon detection of a vehicle by the transmitter-sensor pair, and energizing each relay strobe when the relay strobe photo sensor detects light flashes at the predetermined flash rate. Again, the flashing light of each strobe (primary and relay) effectively warns work zone personnel within the vicinity of the strobe that a vehicle has breached the work zone perimeter, and triggers the upstream relay strobe creating a cascading effect.

The assembly and method of the present invention are significant improvements over the prior art in that the optical warning signal effectively alerts all work zone personnel of a vehicle breaching the work zone perimeter and is free from the interference caused by the excessive noise inherent with construction/maintenance machinery and equipment. Further, the portable nature of the strobe relay units allows them to be placed in close proximity to clusters of workers, workers behind obstructions, or workers required to focus their attention elsewhere. Moreover, because the strobe relays are activated by a predetermined optical repeating flash of light, it is unaffected by the electromagnetic noise inherent in and around work zones. This eliminates false alarms caused by other electromagnetic noise and eliminates a need for FCC compliance. Furthermore, because this intrusion alarm detects vehicles along the entire work zone perimeter adjacent to approaching traffic, the detection integrity of the work area is greatly enhanced over that of the prior art.

The present invention provides a highly reliable vehicle detection system which provides an immediate alarm capable of perception by all work zone personnel which is well suited for the harsh roadway work zone environment. Along with the reduction of work zone personnel injuries and deaths, the worker peace of mind translates into higher productivity.

BRIEF DESCRIPTION OF THE DRAWINGS

In the accompanying drawings which form a part of the specification and are to be read in conjunction therewith, and in which like reference numerals are used to indicate like parts in the various views.

DETAILED DESCRIPTION OF THE PREFERRED EMBODIMENT

Figure 1:
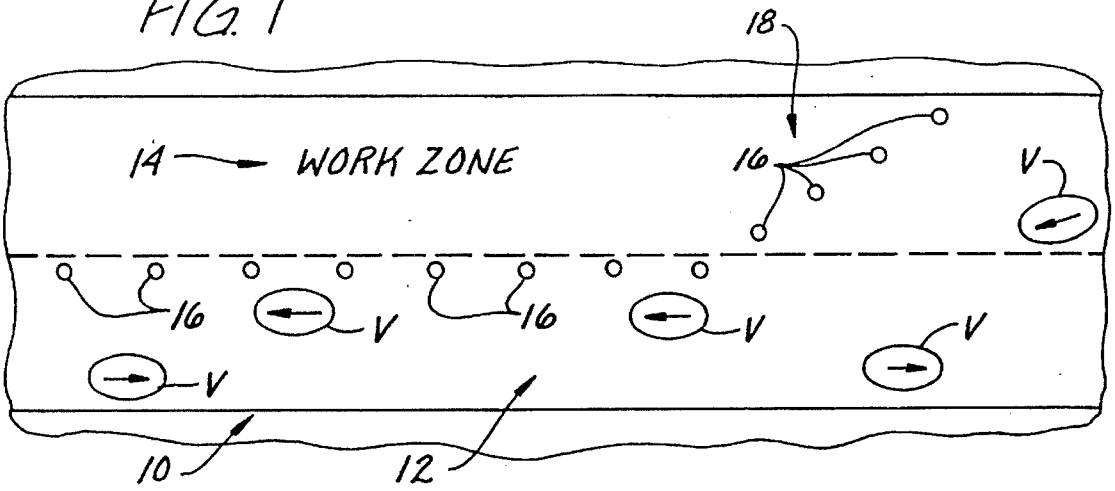
FIG. 1 illustrates a typical roadway work zone with barrels segregating an active lane from the work zone.

FIG. 1 shows a roadway 10 having an active lane 12 and a work zone 14 adjacent the active lane. The active lane has vehicles therein represented by an ellipse and the letter "V". The work zone may include construction crews, utility crews, maintenance crews, and other personnel necessary for roadway upkeep. A plurality of barrels 16 line the work zone perimeter adjacent to the active lane 12 and function to segregate the work zone 14 from the active lane 12. As is commonly known, a taper 18 is formed by the barrels 16 upstream from the work zone 14 to gradually direct oncoming traffic into the active lane 12 and around the work zone 14. Throughout this specification, "upstream" is used to indicate the direction opposite the flow of traffic within the active lane 12 closest to the work zone 14. In this typical work zone 14 upstream is in the direction of the taper 18.

The Manual on Uniform Traffic Control Devices ("MUTCD") recommends setting the length of taper 18 as a function of the posted pre-work zone speed limit and the width of the offset. The MUTCD formula for lane closures of roads with 45 mph speed limits and greater is $L=S\times W$ where L equals the minimum length of taper, S equals the numeric value of the posted pre-work zone speed limit, and W equals the width of offset.

Figure 2:
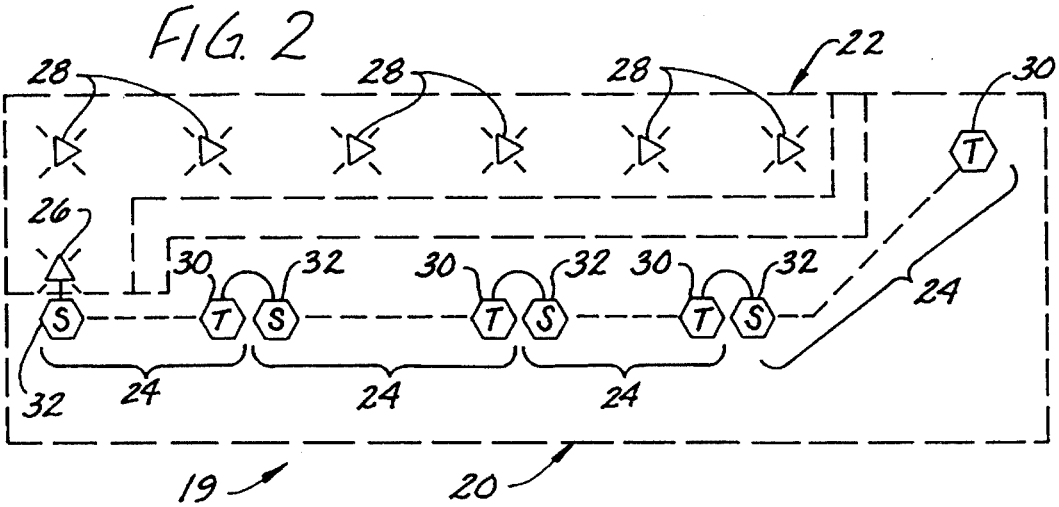
FIG. 2 illustrates an assembly of the present invention with four transmitter-sensor pairs, one primary strobe and six relay strobes.
Figure 3:
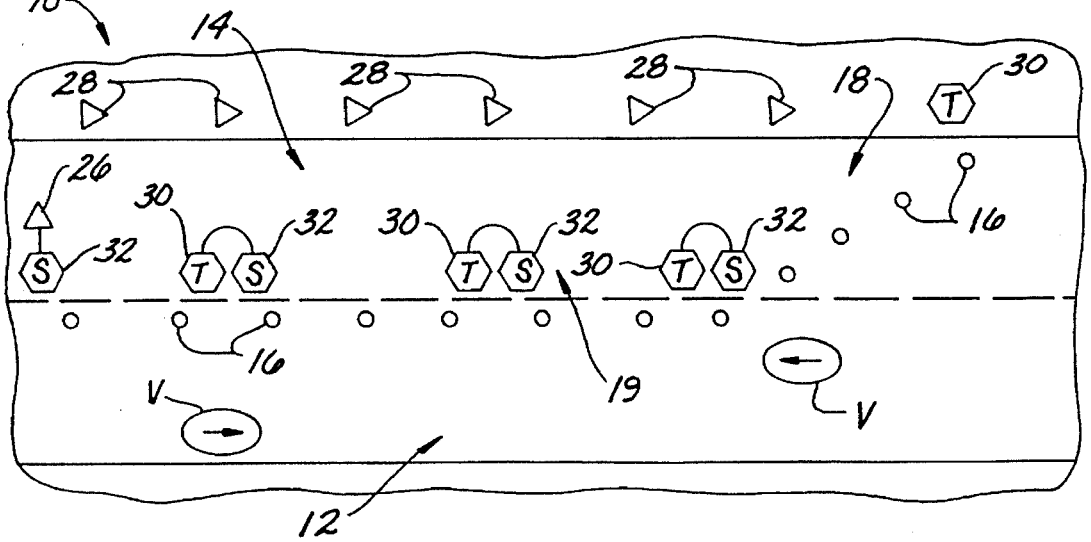
FIG. 3 illustrates the assembly shown in FIG. 2 positioned within the environment of the typical roadway work zone of FIG. 1.

An assembly for signalling when a vehicle enters the work zone constructed according to the principles of the present invention is indicated generally as 19 in FIG. 2 and includes a detector array 20 and an optical warning signal array 22. In the preferred embodiment, the detector array 20 includes a plurality of transmitter-sensor pairs 24 (hereinafter "T-S pairs"), and the optical warning signal array 22 includes a primary strobe 26, and a plurality of relay strobes 28. FIG. 3 illustrates the assembly 19 positioned within the work zone environment illustrated in FIG. 1. These figures are not drawn to scale. The T-S pair components and strobes 26 and 28 are shown to be significantly larger than the barrels 16. This is for illustrative purposes only. Further, the preferred embodiment uses the MUTCD formula for setting the length of the taper 18, but it is understood that the effectiveness of the assembly is not dependent on the length of the taper.

Each T-S pair 24 includes a transmitter 30 and a sensor 32 positioned approximately 1,000 feet to 1,500 feet apart. The T-S pairs 24 are serially arranged along the work zone perimeter adjacent the active traffic lane 12. In fact, the transmitters 30 and sensors 32 may be mounted atop the barrels 16. The preferred embodiment show the farthest upstream T-S pair aligned along the taper 18. Depending on the type of work zone activity and traffic conditions, it is understood that the farthest upstream T-S pair 24 may be positioned downstream from the taper or may incorporate a taper different than the taper 18 defined by the barrels 16 in FIG. 3.

Figure 4:
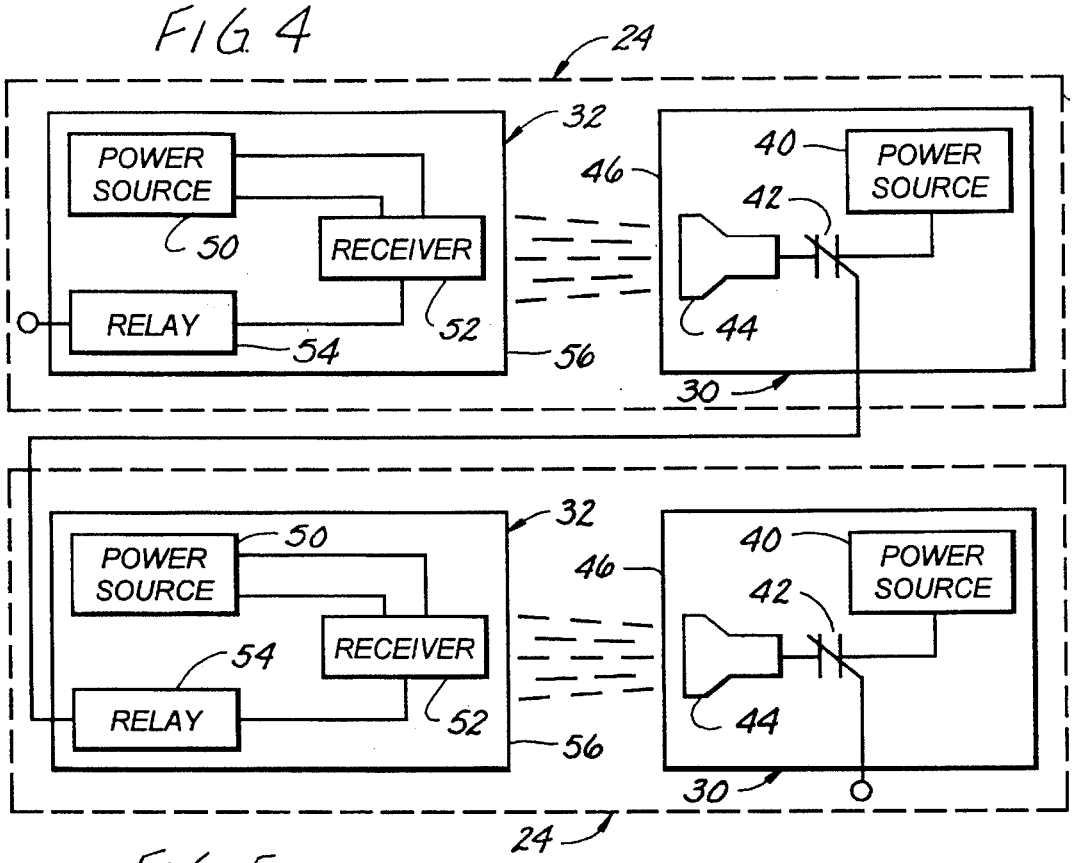
FIG. 4 is a schematic of the transmitter and sensor components of a given transmitter-sensor pair and illustrates the serial connection between transmitter-sensor pairs.

FIG. 4 illustrates in greater detail the transmitter 30, sensor 32, and the serial connection therebetween. The transmitter 30 includes a power source 40 connected through a normally closed relay contact 42 to a transmitting component 44, all housed in a waterproof enclosure 46. The transmitting component 44 preferably transmits a continuous 10 mW, 24.125 GHz microwave signal, with a K-band beam width of 6°. The microwave signal is preferred because unlike the ultrasonic and infrared signals of the prior art, the heat, audible noise, and the electromagnetic noise within the popular communication frequencies inherent to modern roadway work zones have little effect on this microwave signal. The power source preferably includes a self-contained recharging capability using a solar powered panel as well as additional recharging capability via a vehicle battery and/or AC power adaptor. Furthermore, the transmitter 30 may employ an optical telescopic sight (not shown) for mechanical alignment with the sensor 32.

The sensor 32 includes a power source 50 connected to a receiver 52 which in turn is connected to a relay 54, all housed within a waterproof enclosure 56. The power source 50 may be constructed similar to the power source 40 described above with respect to the transmitter 30. The receiver 52 is specifically matched to detect the continuously transmitted 10 mW, 24.125 GHz microwave signal from the transmitter 30 and may include an LED to provide visual confirmation of the T-S pair alignment. Relay 54 is operated by the receiver 52 to open and close the normally closed relay contact 42 of the immediately downstream T-S pair. The relay contact 42 is preferably a transistor and the relay 54 is preferably operated by the receiver 52 to regulate the current to the appropriate transistor terminal thereby opening or closing the connection between power source 40 and transmitting component 44.

Figure 5:
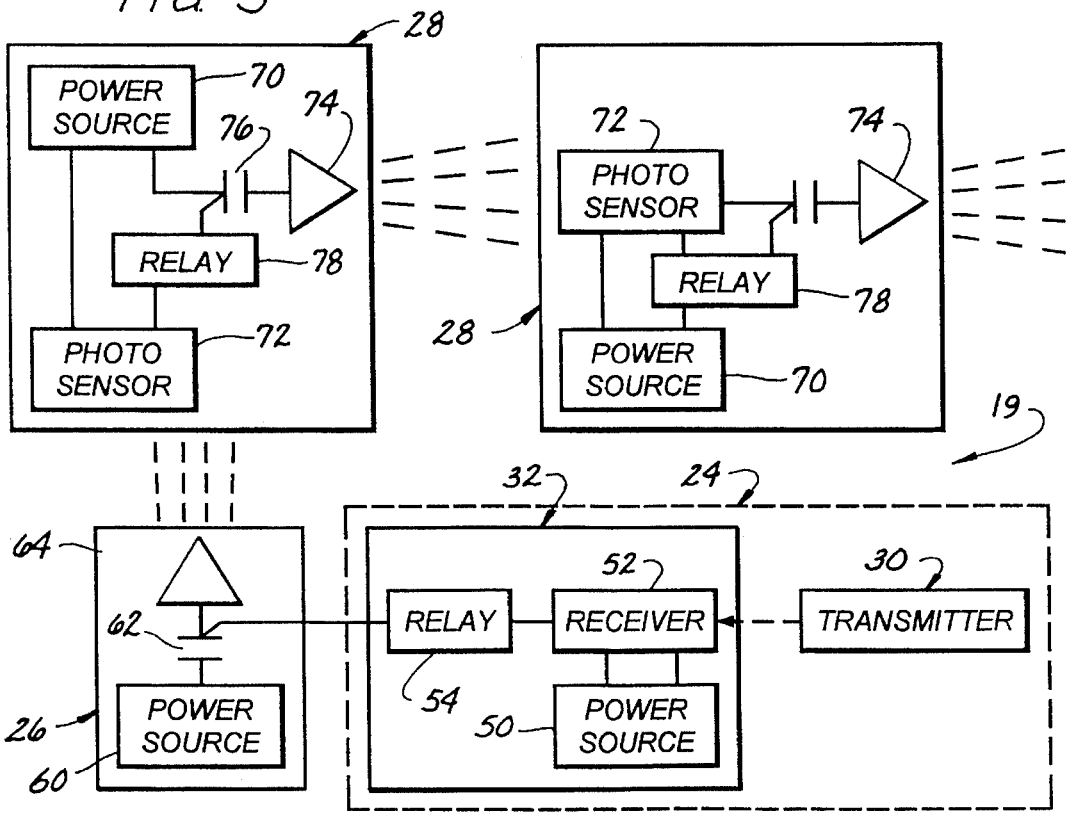
FIG. 5 is a schematic of the primary strobe and relay strobe components.

FIG. 5 illustrates in greater detail the primary strobe 26 and the relay strobes 28. The primary strobe 26 includes a power source 60 connected through a normally open relay contact 62 to an illuminator 64. The normally open relay contact 62 is operated by the relay 54 of the farthest downstream T-S pair. Each relay strobe 28 includes a power source 70 connected to a photoelectric sensor 72 and also connected to an illuminator 74 through a normally open relay contact 76. A relay 78 is connected between the photoelectric sensor 72 and the normally open relay contact 76. Relay contacts 62 and 76 are preferably transistors and the relays 54 and 78 preferably regulate the current to the appropriate transistor terminal thereby opening or closing the connections between power source 60 and illuminator 64, and power source 70 and illuminator 74, respectively. The strobes (primary and relay) are typically 500 feet apart. However, the separation distance may vary depending on road and weather conditions, the strength of the illuminators 64 and 74, and the sensitivity of the photoelectric sensors 72.

The term "strobe" as used herein designates an optical repeater which produces light flashes at a predetermined flash rate. The illuminators 64 and 74 produce visible light flashes at a predetermined flash rate. In the event a vehicle enters the work zone, these illuminators have two primary functions: to alert work zone personnel in the vicinity; and to activate any upstream relay strobes. Preferably, the illuminators are substantially omni-directional and a flash rate between approximately 15 to approximately 30 flashes per second is preferred. The preferred 15–30 flashes per second provides an acceptable response time between the primary strobe 26 and distant upstream relay strobes 28 while having an optimum visual impact on work zone personnel in the vicinity of each strobe. Further, having each strobe follow a pattern of flashing 10 times and resting for a 10-flash period has shown fine results in visual impact and sensor detection capability.

Illuminators adaptable to meet the criteria of the present invention are well known in the art. Likewise, photoelectric sensors capable of detecting light flashes are known in the art.

In operation, when a vehicle passes between a given T-S pair 24, the microwave signal continuously transmitted therebetween is obstructed by the vehicle. The receiver 52 of the T-S pair sensor 32 detects an absence of the microwave signal and the relay 54 of the obstructed T-S pair trips the normally closed relay contact 42 of the immediately downstream T-S pair. The normally closed relay contact opens thereby interrupting power to the transmitting component 44 of this immediately downstream T-S pair and interrupting the transmitted microwave signal of this immediately downstream T-S pair. This chain of events is repeated until the sensor 32 of the farthest downstream T-S pair detects an absence of the microwave signal. Thus, when a vehicle passes between any T-S pair, the sensor 32 of the farthest downstream T-S pair will very rapidly detect a microwave signal interruption.

Because the normally open relay contact 62 of the primary strobe is operated by the relay 54 of the farthest downstream T-S pair, when this T-S pair detects a microwave signal interruption, the relay 54 causes the normally open relay contact 62 to close, thereby energizing the illuminator 64. The illuminator 64 begins flashing at the predetermined flash rate which alerts nearby personnel of the intrusion. The photoelectric sensor 72 of the closest relay strobe 28 detects the predetermined flash rate thereby causing the relay coil 78 to close the normally open relay contact 76 thereby energizing the relay illuminator 74. The illuminator 74 begins flashing at the predetermined flash rate which alerts nearby personnel of the intrusion. The next upstream relay strobe detects the predetermined flash rate and thereby energizes its illuminator. This results in a cascading strobe effect from the primary strobe to the farthest upstream relay strobe.

To minimize feedback the photoelectric sensors 72 of each relay strobe 28 are preferably positioned to sense light flashes originating downstream only. The apparatus 19 may have a continuous flash mode wherein each illuminator, once energized, follows the above-mentioned 10-flash/rest 10-flash cycle or a sequential mode wherein a cascading strobe effect from the primary strobe to the farthest relay strobe is repeated.

When the vehicle which initiated the microwave interruption no longer interrupts the signal (the vehicle has passed out of the work zone perimeter), the sensor 32 of the farthest downstream T-S pair very rapidly detects the revived microwave signal. However, once the primary strobe is energized, it remains activated for 8 to 10 seconds after the microwave signal is reestablished. After the 8–10 second delay, the primary strobe normally open relay contact 62 is again opened thereby de-energizing the primary strobe. Each photoelectric sensor 72 of the relay strobes 28 soon fail to detect the predetermined flash rate thereby de-energizing the relay strobe illuminators 74 and the apparatus 19 is thereby reset.

The method of this invention positions the detector array 20 along a section of the work zone perimeter. Preferably, the plurality of T-S pairs 24 are serially connected along the work zone perimeter section. The optical signal array 22 is activated by the detector array 20 when the detector array detects a vehicle breaching the work zone perimeter. Preferably, the primary strobe 26 of the optical signal array 22 is activated by the detector array 20 and the relay strobes 28 are activated in response to the primary strobe being activated.

The preferred embodiment illustrates the relay strobes 28 aligned on the shoulder of the roadway 10. However, the relay strobes 28 are preferably highly portable to accommodate positioning anywhere within or around the work zone. For instance, construction/maintenance personnel required to stand behind obstacles may place a relay strobe in close proximity thereby making it easier to recognize the optical warning. Likewise, an equipment operator required to look downward a high percentage of the time may place a relay strobe in close proximity to assure recognition of the optical warning.

Another embodiment of the present invention places audio sirens along side the relay strobes providing both visual and audio warning of a vehicle entering the work zone. Preferably, the sirens would be powered by the power sources 70 and energized when the normally open relay contact 76 is closed. -The siren may be continuous or intermittent.

Although illustrated embodiments of the present invention are described herein with reference to the accompanying drawings, it is to be understood that the invention is not limited to those precise embodiments and that various other changes and modifications may be effected therein by one skilled in the art without departing from the scope or spirit of the invention. The scope of the invention is defined solely by the claims, and their equivalents.

What is claimed is:

1. An apparatus for visually warning personnel within a work zone when an object breaches the work zone perimeter, said apparatus comprising:

a detector for detecting said object along a section of the perimeter; and an optical signalling device activated by said detector when said object is detected to thereby visually warn personnel within said work zone, said optical signalling device comprising an array of strobes including a primary strobe and a plurality of relay strobes connected in cascade from said primary strobe, said detector having means for activating said primary strobe, said primary strobe having means for activating at least one of said relay strobes, each strobe flashing visible light at a predetermined flash rate, and each of said relay strobes including a photo sensor for sensing said flash rate from either said primary strobe or another relay strobe to thereby activate at least one of said relay strobes.

2. The apparatus of claim 1 wherein said detector comprises a plurality of T-S pairs connected in cascade.

3. The apparatus of claim 2 wherein said T-S pairs include a transmitter and a receiver.

4. The apparatus of claim 3 wherein said transmitter and receiver of each T-S pair are positioned approximately 1,000 feet to 1,500 feet apart.

5. An apparatus for visually warning personnel within a work zone when a vehicle breaches the work zone perimeter, said apparatus comprising:

a detector array positioned along a section of said work zone perimeter for detecting when said vehicle breaches said perimeter section; and an array of strobes, including a primary strobe and a plurality of relay strobes connected in cascade, each relay strobe including an illuminator for generating a strobe light at a predetermined flash rate, a photo sensor for sensing a strobe light at the predetermined flash rate, and a relay connected between said photo sensor and said illuminator so that as said photo sensor senses the strobe light of another relay strobe it activates the relay to turn on said illuminator, said detector array having means for activating said primary strobe when said vehicle is detected, and said primary strobe having means for activating at least one of said relay strobes, said strobe array thereby visually warning personnel within said work zone when said vehicle is detected.

6. The apparatus of claim 5 wherein said primary strobe includes an illuminator for generating a strobe light at a predetermined flash rate.

7. The apparatus of claim 6 wherein said photo sensor senses a strobe light flashing at the predetermined flash rate of the primary strobe illuminator.

8. An apparatus for visually warning personnel when an object breaches a work zone perimeter, the apparatus comprising:

a detector for detecting an object along a section of the perimeter;

at least one primary strobe for flashing a light signal, the detector activating the primary strobe upon detecting the object; and a first relay strobe for flashing a light signal, the first relay strobe including a photo sensor for activating the first relay strobe upon sensing the light signal from the primary strobe to thereby warn the personnel with the light signals from the primary strobe and the first relay strobe.

9. The apparatus of claim 8, further comprising:

a second relay strobe for flashing a light signal, the second relay strobe including a photo sensor for activating the second relay strobe upon sensing the light signal from one of the primary strobe and the first relay strobe.

10. An apparatus for visually warning personnel within a work zone when an object breaches the work zone perimeter, said apparatus comprising:

a portable detector for detecting said object along a section of the perimeter; and a portable array of strobes including primary strobe and a plurality of relay strobes connected in cascade from said primary strobe, said portable array of strobes being activated by said detector when said object detected to thereby emit a warning signal and attract the attention of personnel within said work zone, wherein said detector activates said primary strobe causing said primary strobe to emit a flashing light signal, and said flashing light signal emitted by said primary strobe activates at least one of said relay strobes causing said one of said relay strobes to emit a flashing light signal when said object breaches said work zone perimeter.

* * * * *